US008915972B2

(12) United States Patent
Campos Silva et al.

(10) Patent No.: US 8,915,972 B2
(45) Date of Patent: Dec. 23, 2014

(54) METHOD AND APPARATUS FOR DETERMINING LOAD FALL IN A LAUNDRY TREATING APPLIANCE

(75) Inventors: Marcelo Campos Silva, Joinville (BR); Alvaro Vallejo Noriega, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 457 days.

(21) Appl. No.: 13/109,080

(22) Filed: May 17, 2011

(65) Prior Publication Data

US 2012/0291206 A1 Nov. 22, 2012

(51) Int. Cl.

| | |
|---|---|
| ***D06F 33/00*** | (2006.01) |
| ***C11D 3/00*** | (2006.01) |
| ***D06F 33/02*** | (2006.01) |

(52) U.S. Cl.

CPC ..... *D06F 33/02* (2013.01)
USPC ..... 8/137; 68/12.01; 318/700; 318/798; 187/391

(58) Field of Classification Search

USPC ..... 8/137; 68/12.01; 318/700, 798, 801
See application file for complete search history.

(56) References Cited

U.S. PATENT DOCUMENTS

| | | | | |
|---|---|---|---|---|
| 4,542,633 | A | 9/1985 | Hirooka et al. | |
| 5,765,402 | A | 6/1998 | Ikeda et al. | |
| 6,029,299 | A | 2/2000 | Baek et al. | |
| 6,374,444 | B2 | 4/2002 | Skrippek et al. | |
| 6,581,230 | B2 | 6/2003 | Weinmann | |
| 7,227,330 | B2 * | 6/2007 | Swamy et al. | 318/798 |
| 7,325,422 | B2 | 2/2008 | Seo et al. | |
| 7,478,547 | B2 | 1/2009 | Okazaki et al. | |
| 2005/0102766 | A1 | 5/2005 | Vande Haar et al. | |
| 2005/0268669 | A1 | 12/2005 | Ko et al. | |
| 2006/0048548 | A1 | 3/2006 | Park et al. | |
| 2009/0044346 | A1 | 2/2009 | Koo | |
| 2010/0024137 | A1 | 2/2010 | Im et al. | |
| 2010/0058543 | A1 | 3/2010 | Choi et al. | |
| 2011/0005339 | A1 | 1/2011 | Ashrafzadeh et al. | |

FOREIGN PATENT DOCUMENTS

| | | | |
|---|---|---|---|
| EP | 2149634 | A2 | 2/2010 |
| JP | 2004350983 | A | 12/2004 |
| JP | 2006247213 | A | 9/2006 |
| JP | 2008054960 | A | 3/2008 |
| JP | 2009247721 | A | 10/2009 |
| JP | 2009247722 | A | 10/2009 |
| KR | 20090013354 | A | 2/2009 |
| WO | 2008099549 | A1 | 8/2008 |
| WO | 2010093185 | A2 | 8/2010 |

OTHER PUBLICATIONS

European Search Report for corresponding European Patent Application No. 12168208.2, Oct. 8, 2012.

* cited by examiner

*Primary Examiner* — Vasu Jagannathan
*Assistant Examiner* — Preeti Kumar

(57) ABSTRACT

An apparatus and method for controlling the operation of a laundry treating appliance having a rotatable treating chamber for holding laundry and a motor for rotating the treating chamber based on a monitored torque signal from the motor of the laundry treating appliance.

13 Claims, 7 Drawing Sheets

METHOD AND APPARATUS FOR DETERMINING LOAD FALL IN A LAUNDRY TREATING APPLIANCE

BACKGROUND OF THE INVENTION

Laundry treating appliances, such as a washing machine, are known to have a configuration where a rotating drum is provided and defines a treating chamber for receiving a laundry load, which may be treated according to an automatic cycle of operation. The cycles of operation may include different phases during which the rotational speed and direction may be controlled. For example, the drum may be rotated to tumble the laundry load within the treating chamber or held against the peripheral wall of the drum (a/k/a "plastered" or "satellized").

SUMMARY OF THE INVENTION

A method for controlling the operation of a laundry treating appliance having a rotatable treating chamber for holding laundry and a motor for rotating the treating chamber. The method includes rotating the treating chamber by actuation of the motor to tumble the laundry within the treating chamber, monitoring a torque signal from the motor while rotating the treating chamber, determining a falling of the laundry within the treating chamber during the rotation of the treating chamber based on a negative slope of the motor torque signal and initiating a control operation in response to the determined falling of the laundry.

DESCRIPTION OF AN EMBODIMENT OF THE INVENTION

Figure 1:
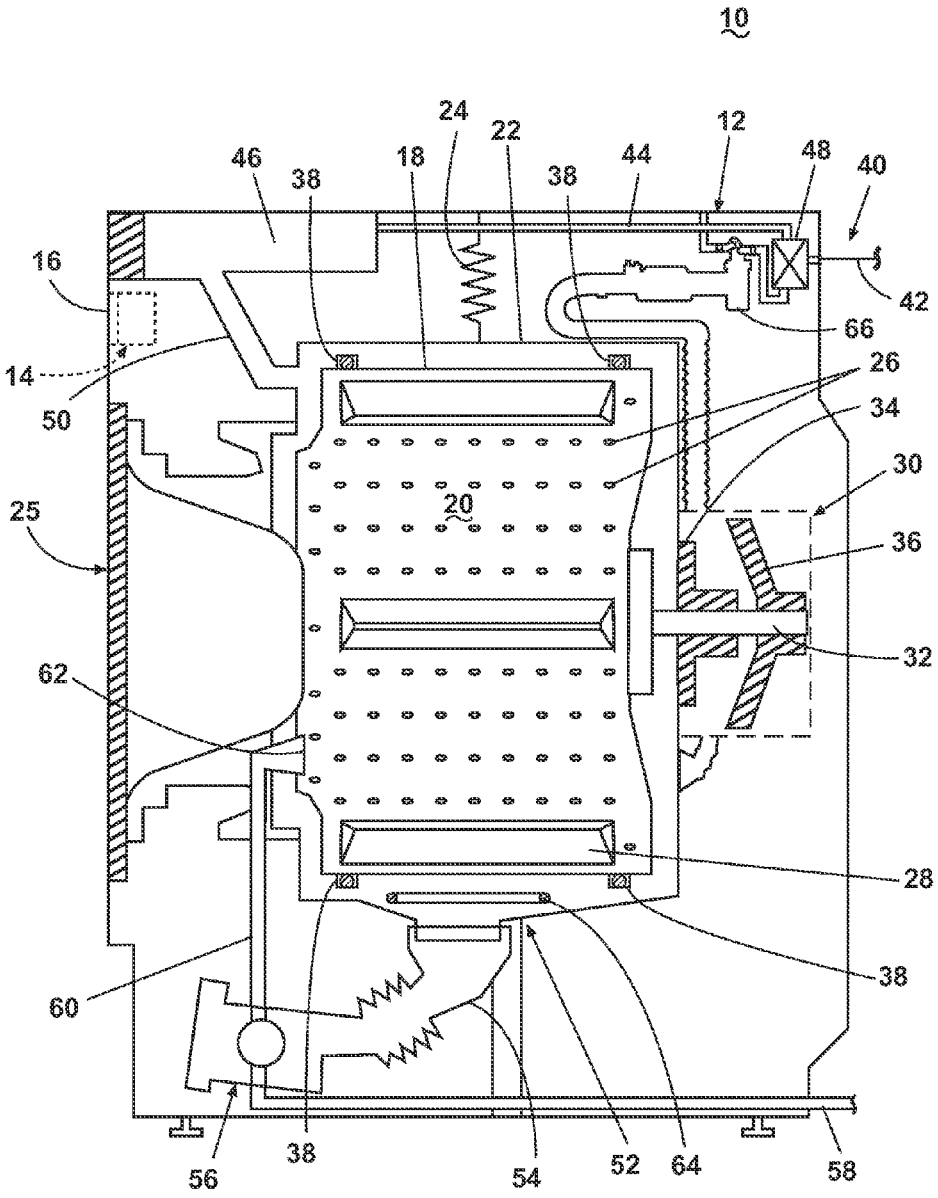
FIG. 1 is a sectional view of a laundry treating appliance according to one embodiment of the invention.

FIG. 1 illustrates a laundry treating appliance in the form of a washing machine 10 according to one embodiment of the invention. The laundry treating appliance may be any machine that treats articles such as clothing or fabrics. Non-limiting examples of the laundry treating appliance may include a horizontal washing machine; a horizontal axis dryer; a combination washing machine and dryer; a refreshing/revitalizing machine; an extractor; and a non-aqueous washing apparatus. The washing machine 10 described herein shares many features of a traditional automatic washing machine, which will not be described in detail except as necessary for a complete understanding of the invention.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a horizontal axis washing machine.

The washing machine 10 may include a housing 12, which may be a cabinet or a frame to which decorative panels may or may not be mounted. A controller 14 may be located within the housing 12 for controlling the operation of the washing machine 10 to implement one or more cycles of operation, which may be stored in a memory of the controller 14. Examples, without limitation, of cycles of operation include: wash, heavy duty wash, delicate wash, quick wash, refresh, rinse only, and timed wash. A user interface 16 may also be included on the housing 12 and may include one or more knobs, switches, displays, and the like for communicating with the user, such as to receive input and provide output.

A rotatable drum 18 may be disposed within an interior of the housing 12 and may at least partially define a treating chamber 20 for treating laundry. The rotatable drum 18 may be mounted within an imperforate tub 22, which may be suspended within the housing 12 by a suspension system 24. Both the tub 22 and the drum 18 may be selectively closed by a door 25. A bellows 26 couples an open face of the tub 22 with the housing 12, and the door 25 seals against the bellows 26 when the door 25 closes the tub 22 and drum 18. The drum 18 may include a plurality of perforations 27, such that liquid may flow between the tub 22 and the drum 18 through the perforations 27. The drum 18 may further include a plurality of baffles 28 disposed on an inner surface of the drum 18 to lift items forming a laundry load contained in the laundry treating chamber 20 while the drum 18 rotates. While the illustrated washing machine 10 includes both the tub 22 and the drum 18, with the drum 18 defining the laundry treating chamber 20, it is within the scope of the invention for the washing machine 10 to include only one receptacle, with the receptacle defining the laundry treating chamber for receiving a laundry load to be treated.

A motor 30 may be coupled with the drum 18 through a drive shaft 32 for selective rotation of the treating chamber 20 during a cycle of operation. It may also be within the scope of the invention for the motor 30 to be coupled with the drive shaft 32 through a drive belt for selective rotation of the treating chamber 20. The motor 30 may be any suitable type of motor for rotating the drum 18. In one example, the motor 30 may be a brushless permanent magnet (BPM) motor having a stator 34 and a rotor 36. Other motors, such as an induction motor or a permanent split capacitor (PSC) motor, may also be used. The motor 30 may rotate the drum 18 at various speeds in either rotational direction.

The washing machine 10 may also include at least one balance ring 38 containing a balancing material moveable within the balance ring 38 to counterbalance an imbalance that may be caused by laundry in the treating chamber 20 during rotation of the drum 18. The balancing material may be in the form of metal balls, fluid or a combination thereof. The balance ring 38 may extend circumferentially around a periphery of the drum 18 and may be located at any desired location along an axis of rotation of the drum 18. When multiple balance rings 38 are present, they may be equally spaced along the axis of rotation of the drum 18.

The washing machine 10 may further include a liquid supply and recirculation system 40. Liquid, such as water, may be supplied to the washing machine 10 from a water supply 42, such as a household water supply. A supply conduit 44 may fluidly couple the water supply 42 to the tub 22 and a treating chemistry dispenser 46. The supply conduit 44 may be provided with an inlet valve 48 for controlling the flow of liquid from the water supply 42 through the supply conduit 44 to either the tub 22 or the treating chemistry dispenser 46. The treating chemistry dispenser 46 may be a single-use dispenser, that stores and dispenses a single dose of treating chemistry and must be refilled for each cycle of operation, or a multiple-use dispenser, also referred to as a bulk dispenser, that stores and dispenses multiple doses of treating chemistry over multiple executions of a cycle of operation.

A liquid conduit 50 may fluidly couple the treating chemistry dispenser 46 with the tub 22. The liquid conduit 50 may couple with the tub 22 at any suitable location on the tub 22 and is shown as being coupled with a front wall of the tub 22 for exemplary purposes. The liquid that flows from the treating chemistry dispenser 46 through the liquid conduit 50 to the tub 22 typically enters a space between the tub 22 and the drum 18 and may flow by gravity to a sump 52 formed in part by a lower portion of the tub 22. The sump 52 may also be formed by a sump conduit 54, which may fluidly couple the lower portion of the tub 22 to a pump 56. The pump 56 may direct fluid to a drain conduit 58, which may drain the liquid from the washing machine 10, or to a recirculation conduit 60, which may terminate at a recirculation inlet 62. The recirculation inlet 62 may direct the liquid from the recirculation conduit 60 into the drum 18. The recirculation inlet 62 may introduce the liquid into the drum 18 in any suitable manner, such as by spraying, dripping, or providing a steady flow of the liquid.

Additionally, the liquid supply and recirculation system 40 may differ from the configuration shown in FIG. 1, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid. By way of a non-limiting example, the inlet valve 48 may also fluidly couple the water supply 42 to a separate bulk dispenser (not shown). Such a configuration may also include an additional nozzle and conduits, which may fluidly couple the bulk dispenser with the treating chamber 20 to provide a spray of bulk treating chemistry to the treating chamber 20 while completely bypassing the treating chemistry dispenser 46. Further, the liquid supply and recirculation system 40 need not include the recirculation portion of the system or may include other types of recirculation systems.

A heating system with a heater, such as sump heater 64 or steam generator 66, may be provided for heating the liquid and/or the laundry.

Figure 2:
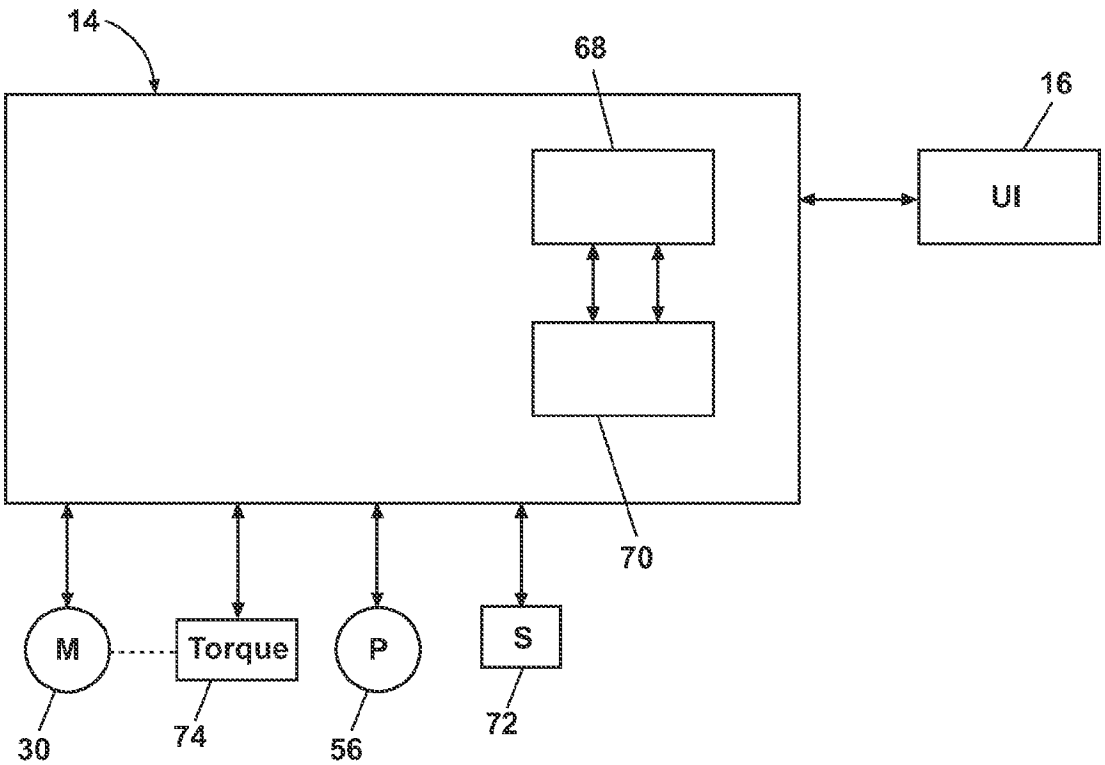
FIG. 2 is a schematic view of a controller of the laundry treating appliance of FIG. 1.

As illustrated in FIG. 2, the controller 14 may be provided with a memory 68 and a central processing unit (CPU) 70. The memory 68 may be used for storing the control software in the form executable instructions that may be executed by the CPU 70 in executing one or more cycles of operation using the washing machine 10 and any additional software. The memory 68 may also be used to store information, such as a database or table, and to store data received from one or more components of the washing machine 10 that may be communicably coupled with the controller 14 as needed to execute the cycle of operation.

The controller 14 may be operably coupled with one or more components of the washing machine 10 for communicating with and controlling the operation of the component to complete a cycle of operation. For example, the controller 14 may be coupled with the user interface 16 for receiving user selected inputs and communicating information with the user, the motor 30 for controlling the direction and speed of rotation of the drum 18, and the pump 56 for draining and recirculating wash water in the sump 52. The controller 14 may also be operably coupled with the inlet valve 48, the steam generator 66, the sump heater 64, and the treating chemistry dispenser 46 to control operation of the component for implementing the cycle of operation.

The controller 14 may also receive input from one or more sensors 72. Non-limiting examples of sensors, which may be communicably coupled with the controller 14 include: a treating chamber temperature sensor, a moisture sensor, a weight sensor, a drum position sensor, a motor torque sensor 74 and a motor speed sensor.

The motor torque sensor 74 may include a motor controller or similar data output, which provides data communication with the motor 30 and outputs motor characteristic information, generally in the form of an analog or digital signal, to the controller 14 that may be indicative of the applied torque. The controller 14 may use the motor characteristic information to determine the torque applied by the motor 30 using software that may be stored in the controller memory 68. The torque sensor 74 may be any suitable sensor, such as a voltage or current sensor, for outputting a current or voltage signal indicative of the current or voltage supplied to the motor 30 to determine the torque applied by the motor 30. Additionally, the sensor may be a physical sensor or may be integrated with the motor and combined with the capability of the controller 14, which may function as a sensor. For example, motor characteristics, such as speed, current, voltage, torque etc., may be processed such that the data provides information in the same manner as a separate physical sensor. In contemporary motors, the motors often have their own controller that outputs data for such information.

The previously described washing machine 10 may be used to implement one or more embodiments of a method of the invention. The embodiments of the method function to determine the falling of the laundry load within the treating chamber 20 and then initiate a control operation in response to the determined falling of the laundry. Prior to describing a method of operation, a brief summary of the underlying physical phenomena may be useful to aid in the overall understanding.

During operation, the motor 30 may rotate the drum 18 at various speeds in either rotational direction. In particular, the motor 30 may rotate the drum 18 at various speeds to cause various types of laundry load movement inside the drum 18. For example, the laundry load may undergo at least one of tumbling, rolling (also called balling), sliding, satellizing (also called plastering), and combinations thereof. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly.

During satellizing, the motor 30 may rotate the drum 18 at rotational speeds, i.e. a spin speed, wherein the fabric items creating the laundry load in the treating chamber 20 are held against the inner surface of the drum 18 and rotate with the drum 18 without falling. This is known as the laundry being satellized or plastered against the drum 18. Typically, the force applied to the fabric items at the satellizing speeds is greater than or about equal to 1G. For a horizontal axis washing machine 10, the drum 18 may rotate about an axis that may be inclined relative to the horizontal, in which case the term "1G" refers to the vertical component of the centrifugal force vector, and the total magnitude along the centrifugal force vector would therefore be greater than 1G.

Figure 3:
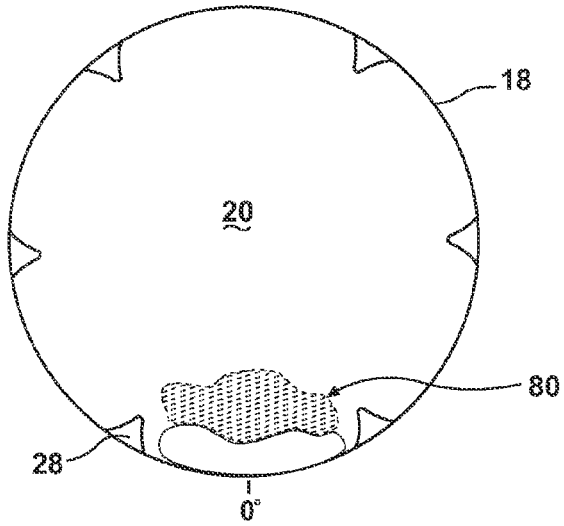
FIGS. 3-5 schematically illustrate a fabric load in a drum of the laundry treating appliance of FIG. 1 and illustrate an exemplary raising and falling movement of the fabric load within the drum, which results in a flipping over of the fabric load.
Figure 4:
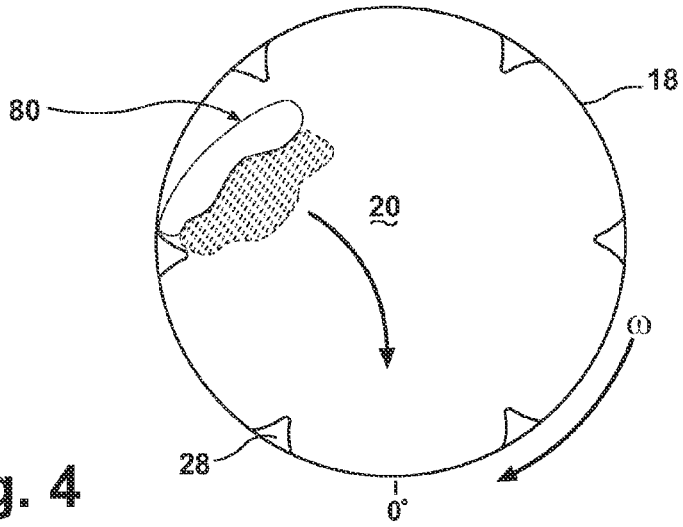
Figure 5:
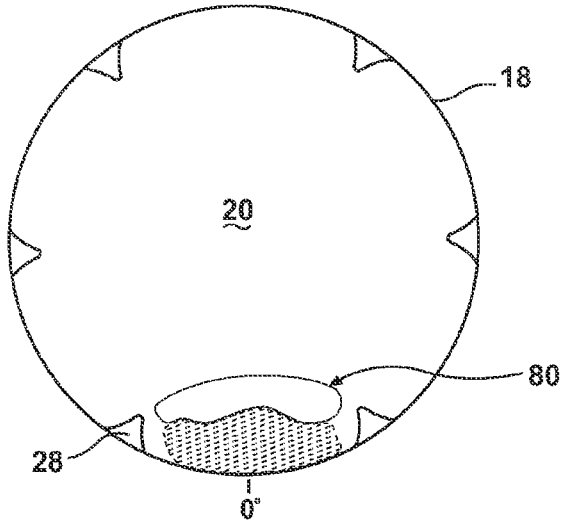

During tumbling, the drum 18 may be rotated at a tumbling speed such that the fabric items of the laundry load rotate with the drum 18 and lifted from a lowest location towards a highest location, but fall back to the lowest location before reaching the highest location. Typically, the centrifugal force applied by the drum 18 to the fabric items at the tumbling speeds is less than about 1G. FIGS. 3-4 illustrate such a lifting/falling movement using an exemplary laundry load 80 comprising multiple fabric items, which for convenience of illustration, is shown as having an upper portion (with dots) and a lower portion (without dots). In FIG. 3, the laundry load is illustrated as sitting at the lowest location, indicated as 0°, of the treating chamber 20. As the drum 18 is rotated at some angular rate, indicated as ω, by the motor 30, the laundry load 80 may follow along with the movement of the drum 18 and be lifted upwards as shown in FIG. 4. The lifting of the laundry load 80 with the drum 18 may be facilitated by either or both the centrifugal force acting on the laundry load and the lifting force applied by the baffles 28. As the laundry load 80 may be lifted up towards the highest location it eventually reaches a point where it will fall as indicated by the arrow in FIG. 4. The laundry load 80 will fall back to the lowest location as illustrated in FIG. 5. Depending upon the speed of rotation and the fabric items making up the laundry load 80, the laundry may fall off from the drum 18 at various points.

When the laundry load 80 falls back to the lowest location it may be flipped such that fabric items that were previously located on the bottom of the laundry load 80 are now located on the top of the laundry load 80. This physical phenomena results from the falling motion of the laundry load 80 in the treating chamber 20. It should be noted that while a complete or perfect flipping of the laundry load 80 during falling may not occur, during every falling the fabric items in the laundry load 80 are often redistributed to some extent within the treating chamber 20. After the laundry load 80 is returned to the lowest location, the process may be repeated or other control actions may be initiated within the washing machine 10.

According to one embodiment of the invention, the falling of the laundry load 80 may be determined and monitored. Specifically, the falling of the laundry load 80 may be determined and monitored by analyzing a signal indicative of the torque of the motor 30. It has been discovered that analysis of the motor torque signal provides valuable information regarding the falling of the laundry load 80. The analysis of the motor torque signal may be done by the controller 14 processing the motor torque signal from the torque sensor 74.

Figure 6:
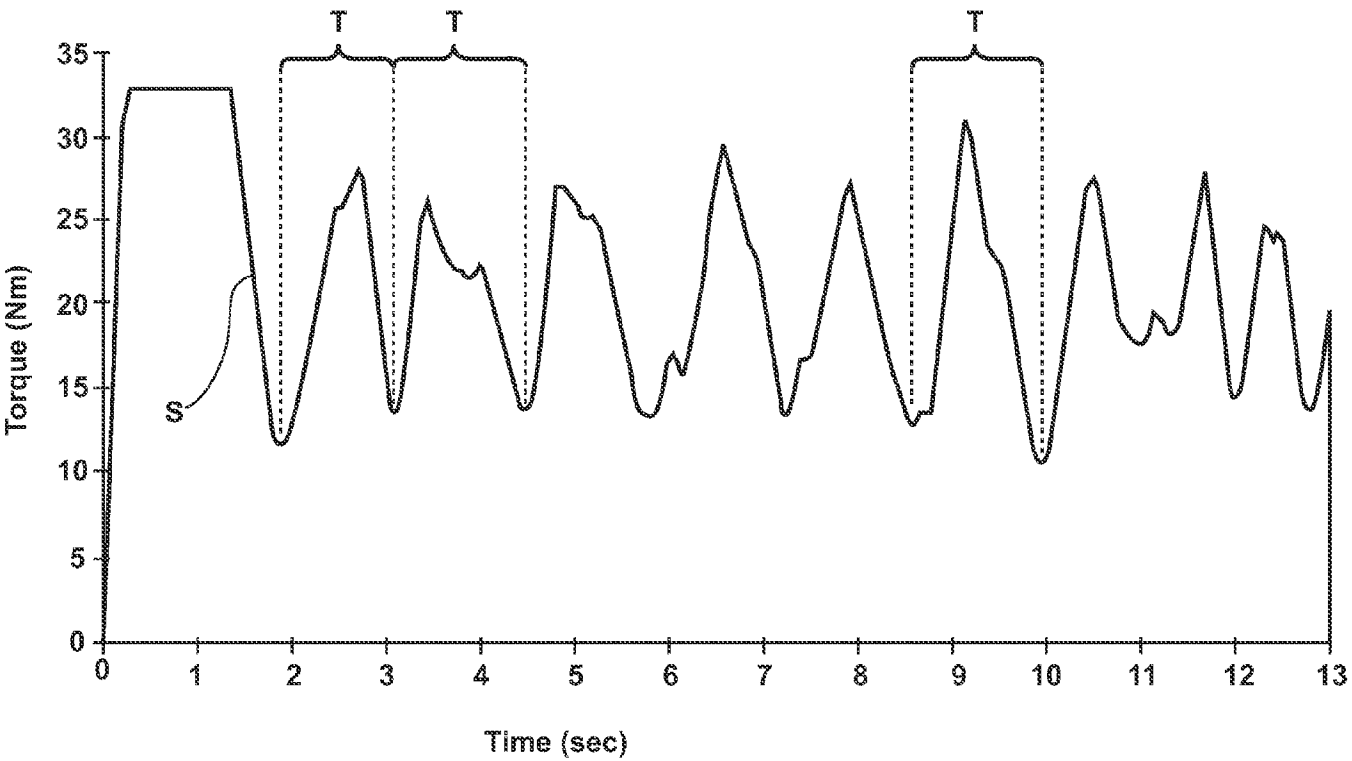
FIG. 6 is an exemplary plot of motor torque versus time which may be utilized to determine the falling of the fabric load.

Referring now to FIG. 6, a plot of a motor torque signal over time is illustrated. FIG. 6 is a snapshot of the motor torque signal when the drum 18 is rotated at a specific speed correlating to tumbling of the laundry load 80. More specifically, the drum 18 was rotated for 13 seconds at 40 revolutions per minute to obtain the plot illustrated. The motor torque signal displays a generally sinusoidal pattern, the frequency of which may be related to the rotational speed of the drum 18. Time periods correlating to the laundry load 80 rotating from the lowest location towards a highest location of the drum 18, and then falling back to the lowest location before reaching the highest location has been indicated as (T) at several, but not all, locations of the plot for exemplary purposes. For each time period T, the torque signal begins at a low value represented by the valley, which corresponds to the falling fabric load just making contact with the lower portion of the drum 18. The weight of the fabric load must then be lifted by the drum 18, which tends to slow the drum 18. To maintain the set rotational speed, the motor torque increases sharply to counter the additional weight of the fabric load. The torque increases until it peaks, which generally coincides with the fabric load separating from the drum 18 and beginning its fall. As the fabric load falls, the torque necessarily decreases as the motor 30 needs less torque to maintain the set rotational speed. The motor torque decreases to the valley until the falling load makes contact with the drum 18 and the cycle repeats. The decreasing torque, illustrated by the negative slope (S) portion of the torque signal correlates to the falling of the laundry load 80 back to the lowest location of the treating chamber 20. Thus, it may be determined from the negative torque signal (S) when the laundry load 80 has fallen back to the lowest location of the treating chamber 20.

A practical implementation of a control based on this approach may use a predetermined threshold negative slope value, which may be determined experimentally, to determine when the negative slope is sufficient to be indicative of the laundry load 80 falling back to the lowest location, such as negative slope (S). When the magnitude of the negative slope (S) satisfies a predetermined threshold, it may be determined that the laundry load 80 has fallen back to the lowest location. The predetermined threshold for the negative slope (S) may be selected in light of the characteristics of a given machine or the characteristics of a given laundry load.

For the purposes of this description, satisfying a predetermined threshold value means that the parameter, in this case the magnitude of the negative slope, is compared with a reference value and the comparison indicates the satisfying of the sought after condition, in this case the falling of the fabric load. References values are easily selected or numerically modified such that any typical comparison can be substituted (greater than, less than, equal to, not equal to, etc.). The form of the reference value and the negative slope value may also be similarly selected, such as by using an average, a maximum, etc. For purposes of this description, it is only necessary that some form of the negative slope value be compared to a reference value in such a way that a determination can be made about the falling load.

Figure 7:
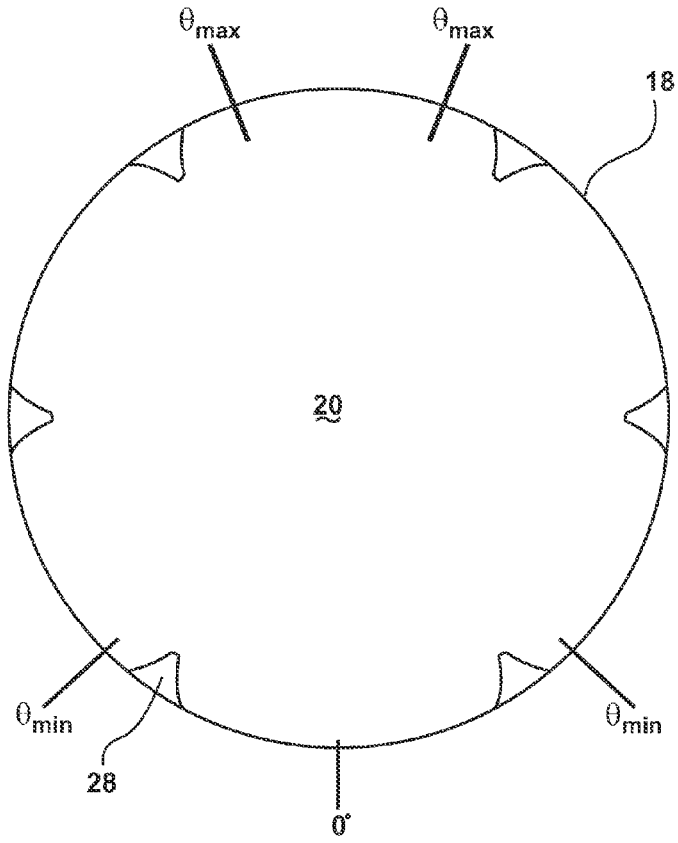
FIG. 7 is a schematic view of the drum of the laundry treating appliance of FIG. 1 and illustrates predetermined minimum rotational angles and predetermined maximum rotational angles during which a falling of the fabric load is detected according to an embodiment of the invention.

Further, it has been determined that to prevent false results, the falling of the laundry load 80 should only be determined within a predetermined rotational position of the drum 18 or treating chamber 20 as determined from its initial location before it began to rotate, which will prevent sliding or rolling fabric loads as well as satellized fabric loads from providing false positives for a falling load. FIG. 7 illustrates a diagram of the drum 18, which indicates the lowest location, indicated as 0°, as well as a predetermined minimum angle and a predetermined maximum angle, indicated as $\theta_{min}$ and $\theta_{max}$ respectively, for each rotational direction of the drum 18. The lowest location denotes the start point of the rotational position of the treating chamber 20. When the rotation of the treating chamber 20 begins and the rotational position of the treating chamber 20 has moved from the lowest location to be between the minimum angle ($\theta_{min}$) and the maximum angle ($\theta_{max}$) it is within the allowed predetermined rotational position and the falling of the laundry load 80 may be accurately determined. Sliding or rolling loads often are not carried through a rotational angle of $\theta_{min}$, yet could result in a negative torque slope. Satellized loads would result in a negative torque slope as gravity helps accelerate the satellized load as it moves from the uppermost position to the lowermost position.

Determining the rotational position of the treating chamber 20 may be achieved in several ways including sensing the rotational position of the drum 18 or calculating the rotational position of the drum 18. The rotational position of the drum 18 may be sensed by any suitable sensor including but not limited to a drum position sensor, which may include a data output to the controller 14 that may be indicative of the rotational position of the drum 18. Alternatively, the position sensor may receive output from the motor 30 and may output a signal to the controller 14 from which the control 14 may calculate the rotational position of the drum 18. For example, the controller 14 may calculate the rotational position of the drum 18 based on the known size of the drum 18 and the information received from the drum position sensor related to the speed of rotation of the drum 18 and the length of time the drum 18 has been rotating.

It has been contemplated that the drum 18 may only be rotated until the negative slope is sensed and the falling of the laundry load is determined, after which the rotation of the drum 18 is stopped. The process may then be repeated or other control actions may be taken. With every such falling, the lowest location may be reset and the determination of the rotational position of the treating chamber 20 may begin anew. More specifically, at the beginning of each rotation of the drum 18 it may be assumed that the rotational position of the drum 18 is such that the laundry load 80 is at its lowest location and that the drum 18 has yet to be rotated. Then the drum 18 may be rotated at a tumbling speed and the rotational position of the treating chamber 20 may be determined. Then the laundry load 80 falls back to the lowest location again and the process may be repeated and it may again be assumed that the rotational position of the drum 18 is such that the laundry load 80 is at its lowest location and that the drum 18 has yet to be rotated.

Figure 8:
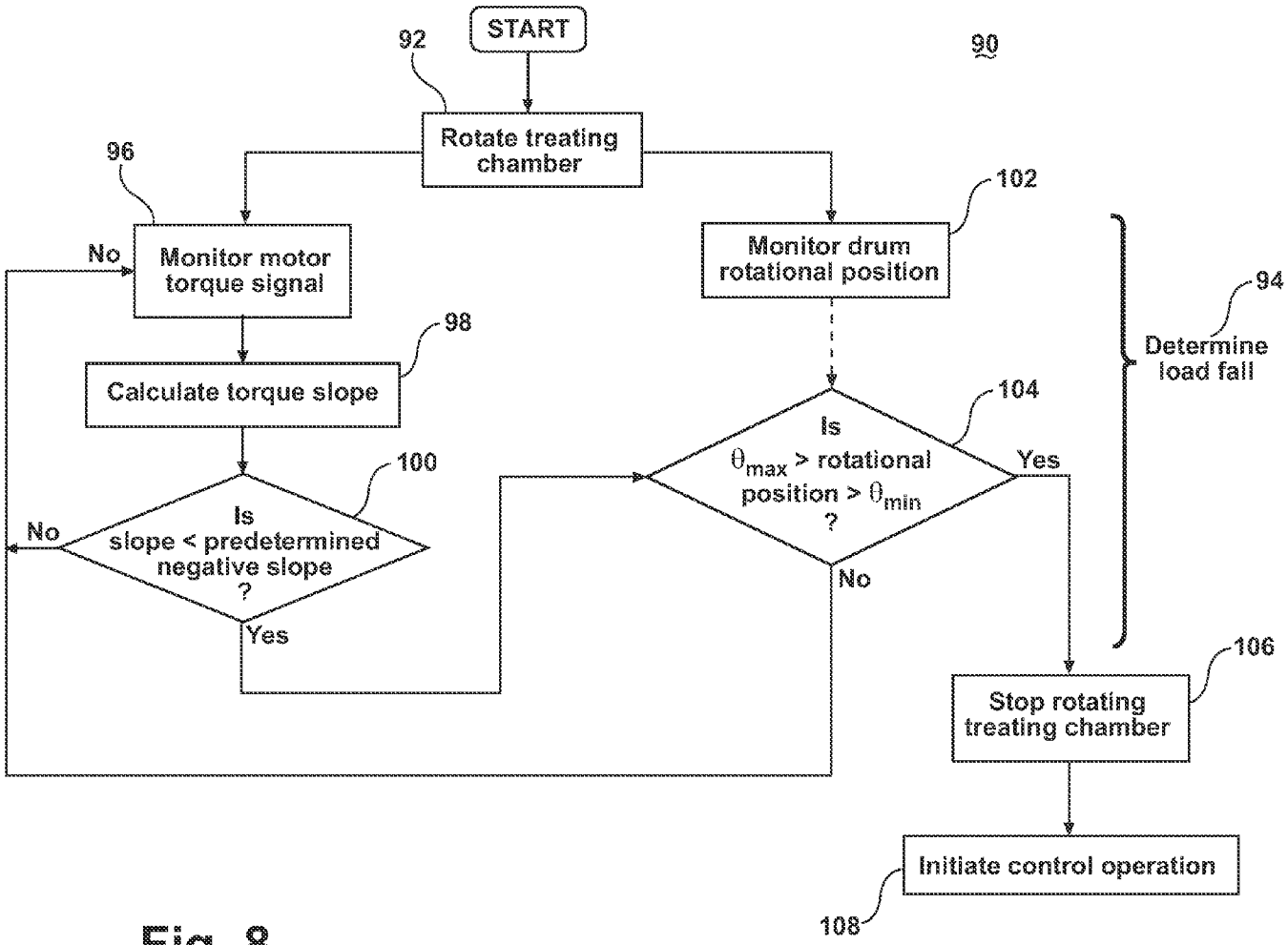
FIG. 8 is an exemplary flow chart illustrating a method for controlling the operation of the laundry treating appliance of FIG. 1 according to an embodiment of the invention.

FIG. 8 illustrates a flow chart corresponding to a method of operating the washing machine 10 based on determining the load fall of the laundry load 80 from the above described phenomena according to one embodiment of the invention. The method 90 may be implemented in any suitable manner, such as automatically or manually, as a stand-alone phase or cycle of operation or as a phase of an operation cycle of the washing machine 10. The method 90 begins at 92 by rotating the drum 18 at a tumbling speed.

At 94, while the drum 18 is rotating at the tumbling speed, the falling of the laundry load 80 may be determined by the controller 14. The determining of the falling of the load at 94 is illustrated as including monitoring the motor torque signal at 96, which as described above may be a direct output from the motor torque sensor 74. At 98, a slope of the motor torque or rate of change in the motor torque over time may be calculated from the monitored signal.

The slope may then be compared to a threshold to see if the calculated slope satisfies the threshold, such as falling below the threshold value. The threshold value for the time rate of change may be selected in light of the characteristics of a given machine. For example, at 100, a determination may be made as to whether the calculated torque slope is less than a predetermined negative slope. If it is determined at 100 that the calculated torque slope is not less than the predetermined negative slope then the process continues to monitor the torque signal at 96, calculate the slope at 98, and determine whether the slope is less than the predetermined negative slope at 100.

It should be noted that while the treating chamber 20 is being rotated, the motor signal is being monitored, and the slope is being determined and compared, the controller 14 may monitor the rotational position of the drum 18 at 102. As explained above, determining the rotational position of the treating chamber 20 may be achieved in several ways including sensing the rotational position of the drum 18 or calculating the rotational position of the drum 18. By way of non-limiting example, at 102 the controller 14 may calculate the rotational position of the drum 18 based on the time of rotation. That is for a given rate of rotation, the time of rotation at that rate correlates to the amount of angular rotation of the drum 18. Thus, the time of rotation may be used by the controller 14 to determine the angular position of the drum 18. In other words, the controller 14 may integrate the rotational rate over time to determine the rotational position of the drum 18. The approach is simplified when the drum 18 is stopped after each falling because the laundry can assumed to be at 0 degrees at the start of rotation of the drum 18. If it is determined at 100 that the calculated torque slope is less than the predetermined negative slope then the method continues at 104. At 104, the controller 14 may determine if the rotational position of the drum 18 is within the predetermined rotational position between the minimum angle ($\theta_{min}$) and the maximum angle ($\theta_{max}$). The determination at 104 may be made by comparing the monitored rotational position of the drum 18 to the predetermined minimum angle ($\theta_{min}$) and maximum angle ($\theta_{max}$) threshold values. The controller 14 may compare the monitored rotational position of the drum 18, either continuously or at set time intervals, to the predetermined minimum angle ($\theta_{min}$) and maximum angle ($\theta_{max}$) threshold values. If it is determined that the monitored rotational position of the drum 18 does not satisfy the predetermined threshold, then the load fall has not been determined and the method starts the load fall determination over by returning to monitoring the torque signal at 96. If it is determined that the monitored rotational position of the drum 18 satisfies the predetermined threshold, such as by being between the minimum angle ($\theta_{min}$) and maximum angle ($\theta_{max}$) the load fall has been determined and the method may continue and the rotation of the treating chamber 20 may be stopped at 106.

Once the rotation of the treating chamber 20 is stopped, then the controller 14 may initiate a control operation at 108 in response to the determined falling of the laundry load 80. At this point, the controller 14 may determine how the washing machine 10 should be controlled based on the phase or cycle of operation begin run. For example, the controller 14 may determine that the laundry load 80 should be sprayed or wetted after every falling and the controller 14 may control the treating chemistry dispenser 46 to dispense treating chemistry to the treating chamber 20 or may control the inlet valve 48 for controlling the flow of liquid into the treating chamber 20 from the water supply 42 or may control the inlet valve 48 for controlling the flow of liquid into the bulk dispenser (not shown) to dispense treating chemistry from the bulk dispenser to the treating chamber 20. This entire process of determining the falling of the laundry load 80 and then initiating a control operation may be repeated until the cycle of operation is completed. Additional control operations may be initiated after the laundry is sprayed or wetted. For example, an additional control operation may be initiated to let the laundry load 80 sit idle for some extended period of time after it has been sprayed or wetted.

Many control operations based on the determined falling of the laundry load 80 have been contemplated and the examples herein should not be seen as limiting the methods of invention.

Figure 9:
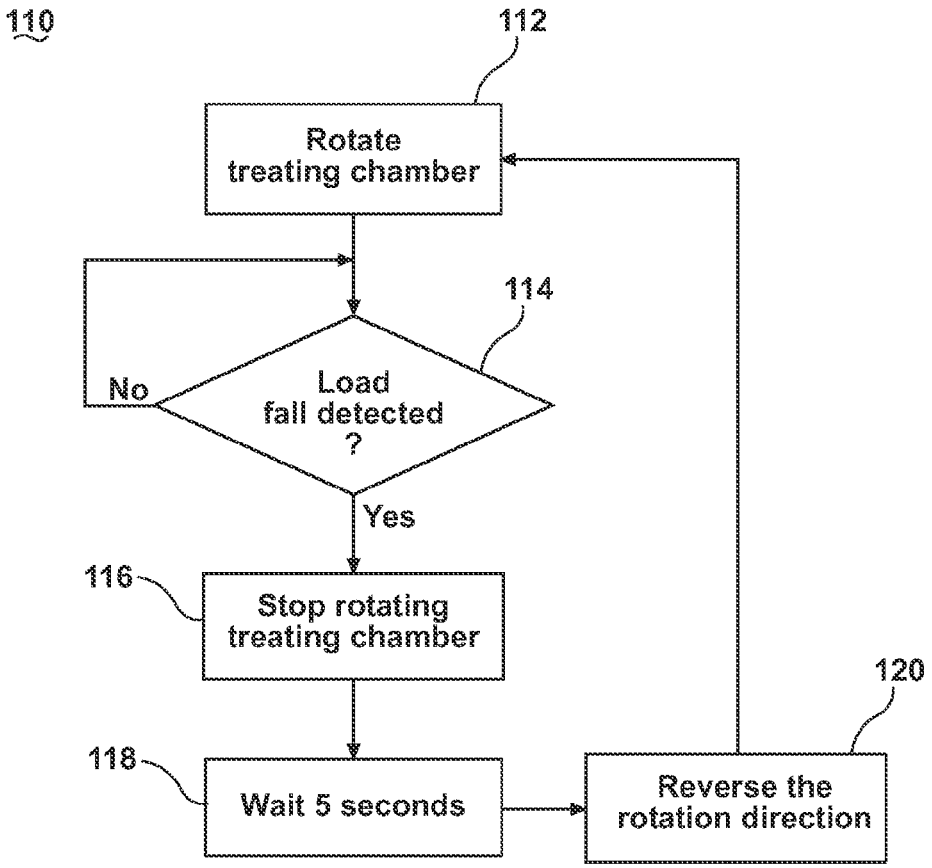
FIG. 9 is an exemplary flow chart illustrating a method for controlling the operation of the laundry treating appliance of FIG. 1 according to an embodiment of the invention.

As another example, FIG. 9 illustrates a method 110 of controlling the rotation of the treating chamber 20 of the washing machine 10 based on the determined falling of the laundry load 80 according to another embodiment of the invention. The method 110 may be implemented in any suitable manner, such as automatically or manually, as a standalone phase or cycle of operation or as a phase of a cycle of operation.

The method 110 begins at 112 by rotating the treating chamber 20 at a tumbling speed. At 114, the falling of the laundry load 80 may be determined by the controller 14. If it is determined that a load fall has not occurred, then the treating chamber 20 continues to be rotated until the load fall is detected. If a falling of the laundry load 80 has been determined then the method may continue and the rotation of the treating chamber 20 may be stopped at 116. In the method 110, the initiating of the control operation includes pausing the rotation of the treating chamber 20 for five seconds at 118 and reversing the rotational direction of the treating chamber 20 at 120. It is illustrated that the method may repeat itself such that the treating chamber 20 may then be rotated in the opposite direction until the falling of the laundry load 80 may again be detected at which point the rotation of the treating chamber 20 may be stopped and a control operation may again by initiated in response to the determined falling of the laundry load 80. Further, it has been contemplated that additional control operations such as the introduction of treating chemistry into the treating chamber 20 may occur before the treating chamber 20 is rotated again in the opposite direction.

A benefit of the methods described above lies in knowing when the laundry load 80 falls. This allows for the washing machine 10 to know where the laundry load 80 is located within the treating chamber 20 and also allows for the washing machine 10 to know that the laundry load 80 has been redistributed within the treating chamber 20. When the location of the laundry load 80 within the treating chamber 20 is known other components of the washing machine 10 may be controlled to achieve better energy management and treating or cleaning during the cycle of operation.

For example, when it is known that the laundry load has been redistributed within the treating chamber 20, the components of the washing machine 10 may be controlled to achieve a more efficient cycles of operation. In the case of a cycle of operation having multiple sprays of treating chemistry knowing that the laundry load 80 has fallen allows different fabric items making up the laundry load 80 to be sprayed after each falling. More specifically, before initially rotating the treating chamber 20 the laundry load 80 may be sprayed. Then the washing machine 10 may rotate the treating chamber 20 and the rotation of the treating chamber 20 may be stopped after it has been determined that the laundry load 80 has fallen. At this point it is known that the laundry load 80 has been flipped, or at the very least redistributed, such that an additional spray of treating chemistry will spray portions of the laundry load 80 which were not previously sprayed. This may allow for a more effective treating operation as multiple fabric items may receive a spray of treating chemistry and may cause a savings in energy because the motor 30 does not need to continuously tumble the laundry load 80 to get an even distribution of the treating chemistry.

Additionally, the overall cycle time may be reduced because monitoring the falling of the laundry load 80 leads to a determination that the laundry load has fallen sooner than prior methods in which the tumbling was maintained for a given time period to ensure that the load had indeed fallen. With the methods 90 and 110, as soon as the load fall is determined, the cycle of operation may immediately continue with initiating a control operation. In summary, with the methods of the invention, the washing machine 10 is able to determine that the laundry load 80 has fallen and the tumbling phases may be reduced, which leads to improved energy consumption, increased control over the cycle of operation, and shorter cycle times.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for controlling an operation of a laundry treating appliance having a rotatable treating chamber for holding laundry and a motor for rotating the treating chamber, the method comprising:

a) rotating the treating chamber by actuation of the motor to tumble the laundry within the treating chamber;

b) monitoring a torque signal from the motor while rotating the treating chamber for a negative slope of the torque signal;

c) determining a flipping of the laundry within the treating chamber during the rotation of the treating chamber based on a presence of the negative slope of the motor torque signal; and d) initiating a control operation in response to the determined flipping of the laundry.

2. The method of claim 1 wherein the initiating the control operation comprises controlling the rotation of the treating chamber.

3. The method of claim 2 wherein controlling the rotation of the treating chamber comprises pausing the rotation of the treating chamber.

4. The method of claim 3, further comprising repeating a) rotating the treating chamber by actuation of the motor to tumble the laundry within the treating chamber, b) monitoring a torque signal from the motor while rotating the treating chamber for a negative slope of the torque signal, c) determining a flipping of the laundry within the treating chamber during the rotation of the treating chamber based on the presence of the negative slope of the motor torque signal and d) initiating a control operation in response to the determined flipping of the laundry after the pausing of the rotation.

5. The method of claim 4 wherein the control operation comprises introducing a treating chemistry into the treating chamber.

6. The method of claim 4, further comprising initiating the control operation only when the determined flipping occurs within a predetermined rotational position of the treating chamber.

7. The method of claim 2 wherein controlling the rotation of the treating chamber comprises reversing the rotation of the treating chamber.

8. The method of claim 1 wherein the control operation comprises introducing a treating chemistry into the treating chamber.

9. The method of claim 1 wherein the determining the flipping of the laundry comprises determining a negative slope value of the motor torque signal.

10. The method of claim 9 wherein the determining the flipping further comprises determining that the negative slope value of the motor torque signal occurs at a predetermined rotational position of the treating chamber.

11. The method of claim 10 wherein the rotational position of the treating chamber is determined by at least one of calculating and sensing the rotational position of the treating chamber.

12. A method for controlling an operation of a laundry treating appliance having a rotatable treating chamber for holding laundry and a motor for rotating the treating chamber, the method comprising:

a) introducing a treating chemistry into the treating chamber;

b) rotating the treating chamber by actuation of the motor to tumble the laundry within the treating chamber;

c) monitoring a torque signal from the motor while rotating the treating chamber for a negative slope of the torque signal;

d) determining a flipping of the laundry within the treating chamber during the rotation of the treating chamber based on a presence of the negative slope of the motor torque signal;

e) pausing the rotation of the treating chamber; and f) introducing additional treating chemistry into the treating chamber.

13. The method of claim 1, further comprising after the introducing the additional treating chemistry repeating b) rotating the treating chamber by actuation of the motor to tumble the laundry within the treating chamber, c) monitoring a torque signal from the motor while rotating the treating chamber for a negative slope of the torque signal, and d) determining a flipping of the laundry within the treating chamber during the rotation of the treating chamber based on the presence of the negative slope of the motor torque signal and then initiating a control operation in response to the determined flipping of the laundry.

* * * * *